US005661474A

United States Patent [19]

Douglas

[11] Patent Number: 5,661,474

[45] Date of Patent: Aug. 26, 1997

[54] HIGHWAY WORK ZONE INTRUSION ALARM SYSTEM

[76] Inventor: William E. Douglas, R.D. #1, Box 151-A, New Florence, Pa. 15944

[21] Appl. No.: 554,705

[22] Filed: Nov. 7, 1995

[51] Int. Cl.[6] ..... G08G 1/02

[52] U.S. Cl. ..... 340/940; 340/908; 340/908.1; 340/666; 200/86 A

[58] Field of Search ..... 340/940, 933, 340/907, 908, 908.1, 665, 666, 693; 200/85 R, 86 A, 86 R

[56] References Cited

U.S. PATENT DOCUMENTS

| | | | |
|---|---|---|---|
| 2,966,877 | 3/1961 | Konold et al. | 340/908 |
| 3,530,432 | 9/1970 | Pope | 340/940 |
| 3,880,537 | 4/1975 | Harris et al. | 404/15 |
| 4,600,178 | 7/1986 | Zucker et al. | 404/6 |
| 4,636,111 | 1/1987 | Joyce | 404/108 |
| 4,862,163 | 8/1989 | Sobut | 340/940 |
| 5,265,556 | 11/1993 | Hall | 116/63 P |
| 5,406,258 | 4/1995 | Carver | 340/541 |
| 5,457,449 | 10/1995 | Kuning et al. | 340/440 |

FOREIGN PATENT DOCUMENTS

WO 87/00326 1/1987 European Pat. Off. .

*Primary Examiner*—Donnie L. Crosland
*Attorney, Agent, or Firm*—Richard C. Litman

[57] ABSTRACT

A work zone intrusion alarm system which sounds a siren to warn highway workers in the event a vehicle enters a work zone. Workers may thus react to errant vehicles in time to avoid injury. The work zone intrusion alarm system is composed of a series of pneumatic sensing lines arranged within a highway work zone adjacent a perimeter separating the work zone from oncoming traffic. The sensing lines are connected at junction boxes which include pressure switches. A warning alarm including a siren is activated by the pressure switch upon the compression of a sensing line when driven over by an errant vehicle.

20 Claims, 3 Drawing Sheets

HIGHWAY WORK ZONE INTRUSION ALARM SYSTEM

BACKGROUND OF THE INVENTION

1. FIELD OF THE INVENTION

The present invention relates to a protection device for highway workers and more particularly to a warning device for alerting highway workers of oncoming vehicles which have strayed toward the work zone.

2. DESCRIPTION OF THE PRIOR ART

The number of highway work zone related fatalities has nearly doubled in the last ten years. In 1991, there were approximately 25,000 disabling injuries in work zones. In 1993, according to the National Highway Transportation Safety Administration, there were 762 work zone fatalities on United States roadways. The Occupational Safety and Health Administration reports that 59% of highway workers killed are struck by motorists mistakenly entering work zones. Numerous safety devices have been developed to prevent accidents between highway workers and errant vehicles. Examples include the method of protecting a roadway maintenance and construction site disclosed in U.S. Pat. No. 4,600,178 issued Jul. 15, 1986, to S. Zucker et al. and the apparatus for road repair work including a protective cage disclosed in U.S. Pat. No. 4,636,111 issued Jan. 13, 1987, to J. V. Joyce. Such barriers prevent errant vehicles from entering a limited area of a roadway. For larger temporary work zones it is not always possible to erect barriers to keep vehicles from entering all parts of a work zone. Non-barrier devices have been developed to warn drivers of road hazards such as construction work zones. World patent application No. WO 87/00326 published Jan. 15, 1987, shows such a warning signal. U.S. Pat. No. 3,880,537 issued Apr. 29, 1975, to F. C. Harris et al. discloses another road hazard warning device. These devices rely on warning the driver of the vehicle to prevent accidents. However, vehicles continue to mistakenly enter highway work zones despite the existence of such warning devices. It is therefore advantageous to provide highway workers warning of oncoming errant vehicles in time to take evasive action. U.S. Pat. No. 5,265,556 issued Nov. 30, 1993, to J. R. Hall shows such a device. The Hall device consists of a traffic control barrier which if knocked over by an oncoming vehicle emits a loud audible alarm. The Hall device warns workers of errant vehicles entering the workzone at a single location and is useful for a single occurrence. A highway signal device which may detect vehicles over a larger area is shown in U.S. Pat. No. 2,966,877 issued Mar. 29, 1957, to W. G. Konold et al. The mechanical actuator of Konold limits the maximum length of the pneumatic tube and requires the signal device to be mechanically connected to the pneumatic tube. Electrical pressure switches connected to pneumatic tubing are shown in U.S. Pat. No. 5,406,258 issued Apr. 11, 1995, to D. W. Carver. The security barrier of Carver relies on the release of pressure due toga rupture of the tubes of the device to actuate an alarm.

None of the above inventions and patents, taken either singly or in combination, is seen to describe the instant invention as claimed.

SUMMARY OF THE INVENTION

Many of the injuries and fatalities due to errant vehicles entering work zones can be avoided if highway workers have time to react to errant motorists. Without advanced warning highway workers are frequently unaware of oncoming errant vehicle until it is too late.

The present highway work zone intrusion alarm system warns highway workers of oncoming errant vehicles which have entered the work zone or a buffer zone maintained between the workzone and oncoming traffic. The system is easily deployed, reliable, and durable. The instant invention includes a sensing system for deployment along the perimeter of the buffer zone. The sensing system is configured to be able to extend from the work zone to the beginning of the buffer zone. The perimeter sensing system includes a series of sensing lines. The sensing lines detect vehicles which enter the buffer zone as they pass over a sensing line. The perimeter sensing system is connected to an alarm module located in a position to give maximum warning to all workers in the work zone. The alarm-module is connected to the sensing system by a connection cable, thus providing the versatility required to advantageously position the alarm module. Upon detection of an errant vehicle by the sensing system, the alarm module activates a loud siren warning all workers in the work zone of an approaching errant vehicle. The alarm module may also include additional warning devices such as a strobe.

The highway work zone intrusion alarm system uses a minimum number of reliable durable components to best withstand the rigors of the highway work zone environment. The system includes elements such as an industrial strength steel reel for convenient storage, transportation, and deployment of the sensing line.

Accordingly, it is a principal object of the invention to provide a highway work zone alarm system which warns highway workers of oncoming vehicles entering a work zone.

It is another object of the invention to provide such a system which is easily stored, deployed, and utilized.

It is a further object of the invention to provide such a system where an alarm is positionable remote from a sensor.

Still another object of the invention is to provide such a system which will detect all oncoming errant vehicles.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
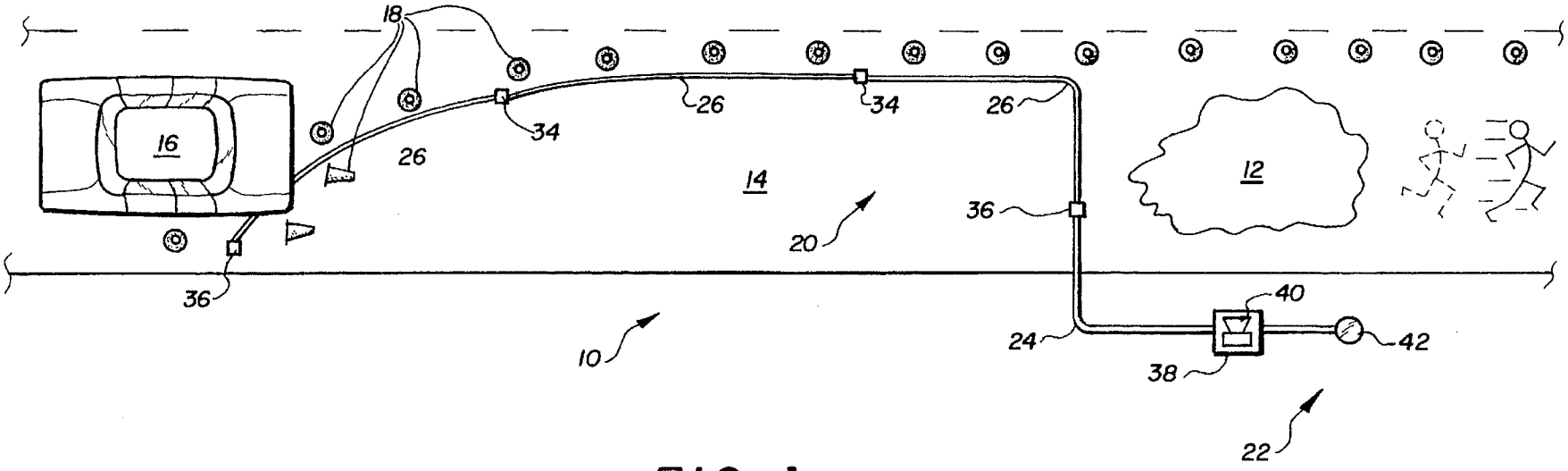
FIG. 1 is an environmental plan view of the invention as deployed.

A highway work zone intrusion alarm system 10 of the present invention is shown in FIG. 1. Alarm system 10 is shown deployed to protect highway workers occupying a typical highway work zone 12. The work zone is located in a traffic lane which has been closed by a series of portable barriers 18. As is common, a buffer zone 14 is formed by closing the lane for a significant distance before the work zone 12. Alarm system 10 includes a perimeter sensing system 20 for sensing errant vehicles. Sensor 20 is deployed just inside the perimeter of the buffer zone 14 for maximizing the warning time provided. A base alarm module 22 is positioned away from traffic near work zone 12. A long connecting cable 24 links perimeter sensing system 20 with base alarm module 22. As deployed alarm system 10 will be activated as soon as an errant vehicle 16 enters buffer zone 14 to provide advanced warning of the oncoming vehicle 16 to workers in work zone 12.

Figure 2:
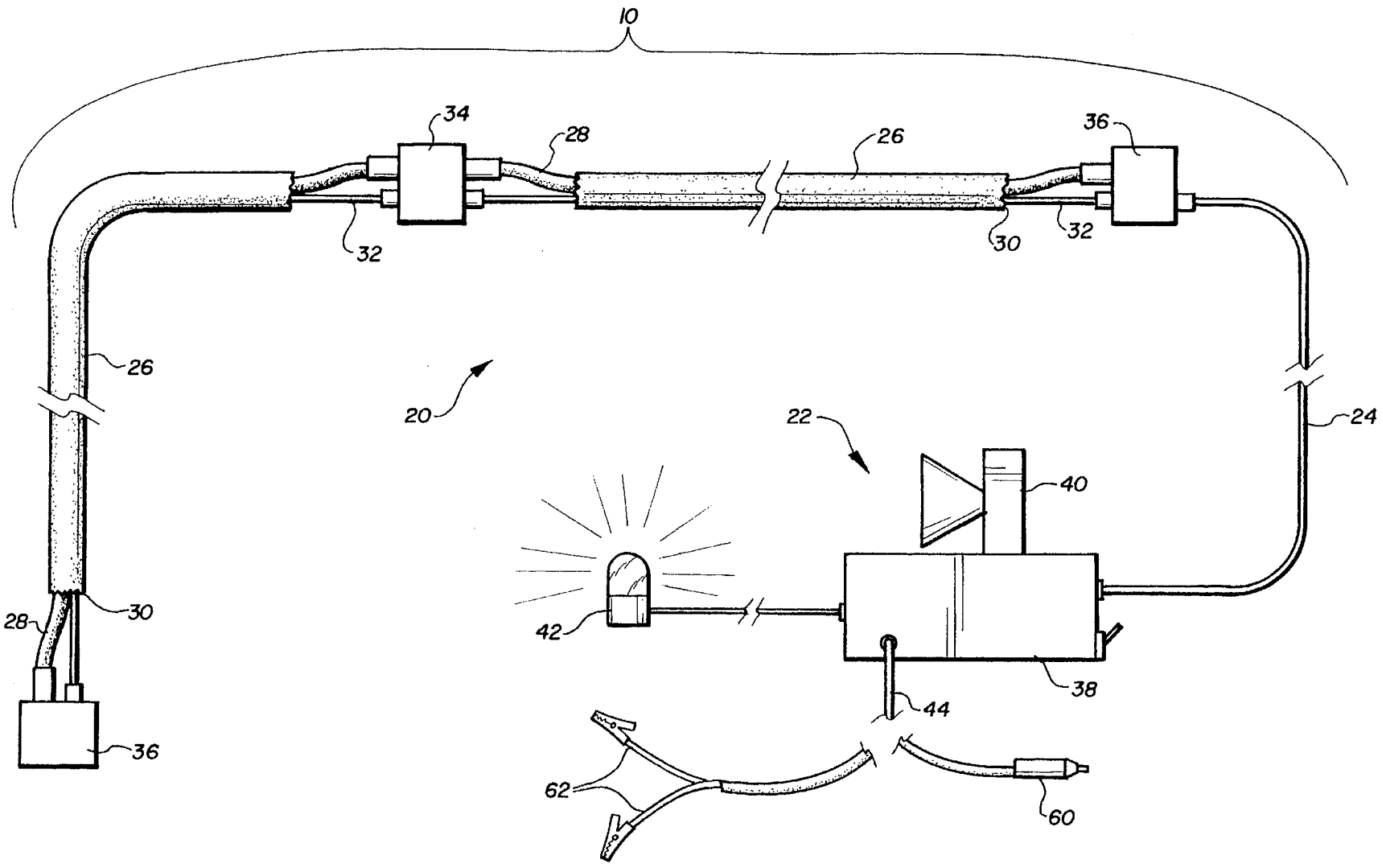
FIG. 2 is a diagrammatic view of the invention as deployed.

The components of highway alarm work zone intrusion alarm system 10 are best shown in FIG. 2. Perimeter sensing system 20 includes a series of sensing lines 26 for detecting the passage of vehicles. Each of sensing line 26 includes a flexible and resilient pneumatic tube 28 terminating at opposite ends. Tube 28 is surrounded by a braided sleeve 30. Also included within braided sleeve 30 is an electrical switch connection line 32. Adjacent sensing lines 26 are connected in series by junction boxes 34. Forming the ends of perimeter sensing system 20 are terminal boxes 36. One of the two terminal boxes 36 is connected to base alarm module 22 by connecting cable 24. Base alarm module 22 includes a magnetic base 38. A siren 40 is attached to base 38. Base 38 includes connectors for connecting base 38 to connecting cable 24 an optional strobe 42, and a power supply line 44. Power supply line 44 is configured to terminate in cigarette lighter plug 60 for connection to the 12 volt power system of a parked vehicle or alternately may be adapted to connect directly to a standard 12 volt vehicle battery using clips 62. Also, included on base 38 is power toggle switch 46 connected to power supply line 44.

Figure 3:
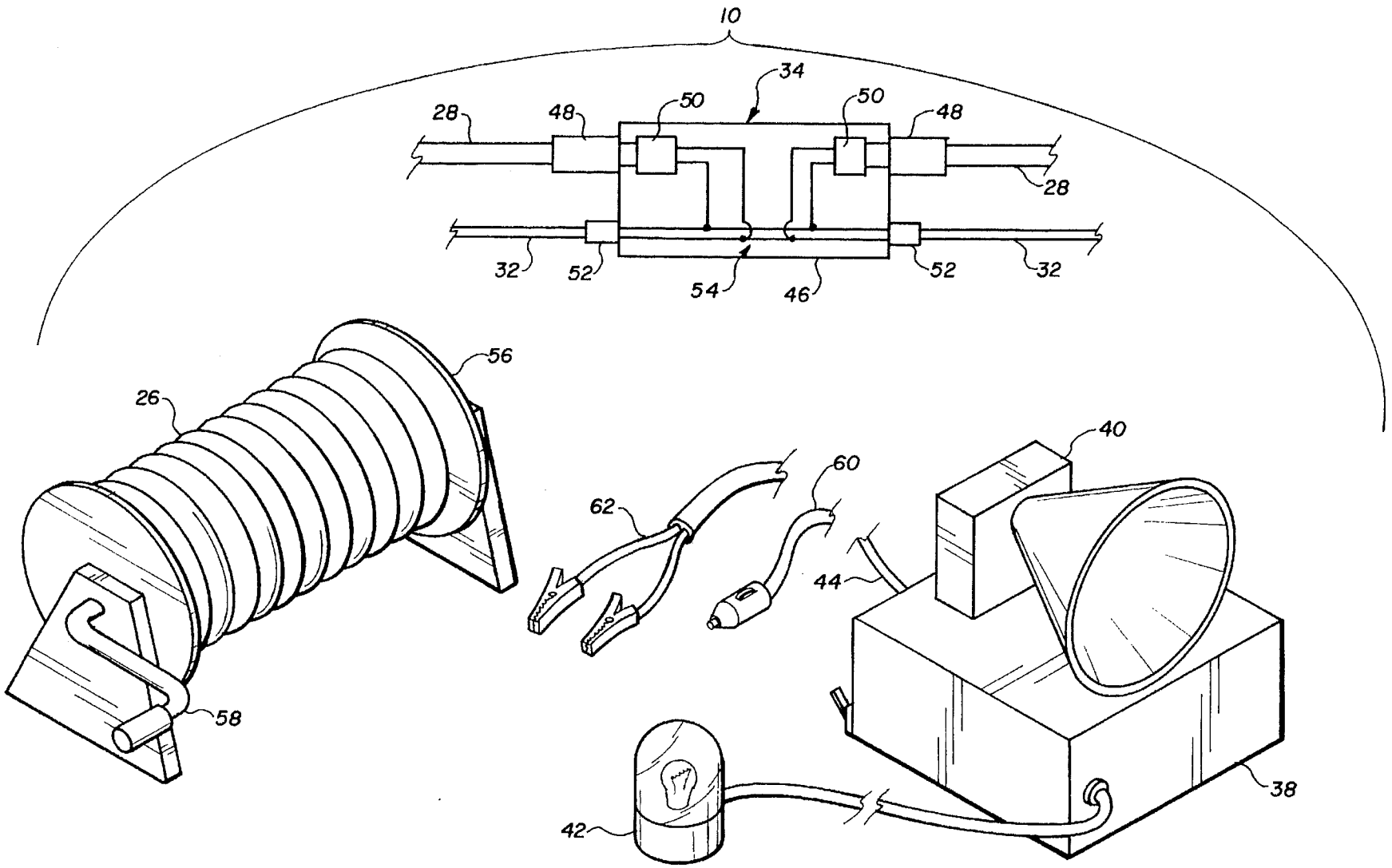
FIG. 3 is a view of the components of the invention in a stored position.

Additional features of the components of highway work zone intrusion alarm system 10 are shown in FIG. 3. A junction box 34 is shown in section and includes a weatherproof housing 46, a pair of tube connections 48, and a pair of weatherproof pressure switches 50. Housing 46 is made from die cast aluminum and is sealed for all-weather performance. Each pressure switch 50 is in communication with a tube connection 48. Tube connections 48 comprise hose nipples to which tubes 28 are clamped with hose clamps. Also included in each junction box 34 are a pair of weatherproof electrical connectors 52 for connection to switch connection lines 32. Electric circuitry 54 connects the pair of electric connectors 52 to each other and to each pressure switch 50. Thus, each end tube 28 is in communication with a pressure switch 50. Terminal boxes 36 are identical to junction boxes 38 except that terminal boxes 36 include only a single tube connection 48 and a single pressure switch 50. FIG. 3 also shows the other components of alarm system 10 in a stowed position for transport. Sensing lines 26 are wound on steel reel 56. Reel 56 is shown with hand crank 58, but optionally may be wound and unwound using an electric motor (not shown).

In operation perimeter sensing system 20 is laid just inside the perimeter of buffer zone 14. Base alarm module 22 is disposed proximate workzone 12 in a position to be heard by all workers therein. Magnetic base 38 and power supply line 44 allow alarm module 22 to be conveniently mounted on a parked vehicle at the work site. Power supply line 44 is attached to a power source such as a 12 volt power source carried by the parked vehicle. Perimeter sensing system 20 detects errant vehicles entering buffer zone 14. As errant vehicle 16 drives over a sensing line 26, tube 28 is compressed creating an air pulse within tube 28. The pulse in tube 28 activates pressure switches 50 in communication with the specific tube driven over. Switches 50 are connected to base alarm module 22 through the circuit comprising switch connection lines 32 connected by junction boxes 34 and connecting cable 24 connected through one terminal box 36 to a switch connection line 32. This circuitry is connected in base 38 to power supply line 44, siren 40, and optional strobe 42 such that upon activation of any of the switches 50 siren 40 and, if connected, strobe 42 will flash. Siren 40 will sound a loud blast sufficient to warn all workers in the work zone of the oncoming vehicle. A blast of more than 100 decibels for about 8 seconds is sufficient for this purpose and is achieved using a 100 watt siren. A 12 volt vehicle battery may be used to power a 100 watt siren which will draw more than 9 amps upon activation of the siren.

For ease of handling and manufacture, and to ensure that the passing of a vehicle creates a sufficient pulse within tubes 28, sensing lines 26 are limited in length. A length of about 100 feet is suitable. A minimum of three sensing lines 26 are connected in series to form perimeter sensing system 20 to provide adequate advanced warning to highway workers. However, additional sensing lines may be easily added to increase the length of perimeter sensing system 20 when larger buffer zones and work zones are formed.

It is to be understood that the present invention is not limited to the sole embodiment described above, but encompasses any and all embodiments within the scope of the following claims.

I claim:

1. A highway work zone intrusion alarm system comprising:

an errant vehicle sensor including, at least one sensing line, each sensing line including, a pneumatic tube terminating at a first end and a second end, a pair of electric pressure switches, each in communication with one end of said pneumatic tube, said electrical pressure switches closing in reaction to a, pressure pulse within said pneumatic tube, and an electric switch connection line extending from said first end of said pneumatic tube to said second end of said pneumatic tube, said connection line electrically connecting said pair of pressure switches; and alarm means for producing a warning signal upon closing of any of said pressure switches when a pressure pulse has been produced within said pneumatic tube indicating said pneumatic tube has been driven over by an errant vehicle, said alarm means electrically connected to said switch connection line.

2. The highway work zone intrusion alarm system of claim 1, wherein each said sensing line further includes a sleeve containing said pneumatic tube and said electric switch connection line.

3. The highway work zone intrusion alarm system of claim 1, further including an electric connection cable connecting said errant vehicle sensor with said alarm means, said connection cable allowing said alarm means to be disposed distant from said errant vehicle sensor.

4. The highway work zone intrusion alarm system of claim 1, further including a reel, each said sensing line wound upon said reel for storage.

5. The highway work zone intrusion alarm system of claim 1, wherein multiple sensing lines are connected to form said errant vehicle sensor.

6. The highway work zone intrusion alarm system of claim 5, wherein said errant vehicle sensor includes three sensing lines.

7. The highway work zone intrusion alarm system of claim 5, wherein said multiple sensing lines are connected with junction boxes, each said junction box including, a housing containing two of said pressure switches, one from each of said sensing lines connected by said junction box, a pair of electrical connectors on said housing, said pair of electrical connectors including, a first electrical connector connected to said electric switch connection line of one of said sensing lines connected by said junction box, and a second electrical connector connected said electric switch connection line of another of said sensing lines connected by said junction box, and electric circuitry contained in said housing, said electric circuitry connecting said first connector, said second connector and said pressure switches contained in said housing.

8. The highway work zone intrusion alarm system of claim 7, further including an electric connection cable connecting said errant vehicle sensor with said alarm means, said connection cable allowing said alarm means to be disposed distant from said errant vehicle sensor.

9. The highway work zone intrusion alarm system of claim 8, wherein said errant vehicle sensor further includes a terminal box for connecting one of said sensing lines to said electric connection cable, said terminal box including, a housing containing one of said pressure switches of said sensing line connected to said connection cable, a pair of electrical connectors on said housing, said pair of electrical connectors including, a first electrical connector connected to said electric switch connection line of said sensing line connected to said connection cable, and a second electrical connector connected to said connection cable, and electric circuitry contained in said housing, said electric circuitry connecting said first connector, said second connector and said pressure switch contained in said housing.

10. The highway work zone intrusion alarm system of claim 1, wherein said alarm means comprises a alarm module including a siren.

11. The highway work zone intrusion alarm system of claim 10, wherein said alarm module further includes a strobe.

12. The highway work zone intrusion alarm system of claim 10, wherein said alarm module includes a magnetic base.

13. The highway work zone intrusion alarm system of claim 10 wherein said alarm module includes a power supply line for connecting said siren to an external power source, said supply line including electrical plug means.

14. The highway work zone intrusion alarm system of claim 10 wherein said alarm module includes a power supply line including a battery connector adapter for connecting said power supply line directly to a battery.

15. A highway work zone intrusion alarm system comprising:

a sensor including, a plurality of connected sensing lines, each sensing line including, a tube, and a connection line, and a plurality of junction boxes connecting adjacent sensing lines, each junction box including, a pressure switch in communication with said pneumatic tube of one of said sensing lines, and circuitry connecting said connection lines of the adjacent sensing lines to one another and to said pressure switch; and an alarm module electrically connected to said connection line of one of said sensing lines of said sensor, said alarm module including a siren; whereby said alarm module is activated upon an errant vehicle driving over said tube of one of said sensing lines thereby creating a pressure pulse within said tube to actuate said pressure switch and thus activate said alarm module.

16. The highway work zone intrusion alarm system of claim 15, wherein each of said sensing lines of said sensor further include a sleeve containing said pneumatic tube and said connection line.

17. The highway work zone intrusion alarm system of claim 15 further including a connection cable connecting said alarm module to one of said sensing lines of said sensor, said connection cable enabling remote positioning of said alarm module from said sensor.

18. The highway work zone intrusion alarm system of claim 15 wherein said alarm module further includes a strobe.

19. The highway work zone intrusion alarm system of claim 15 wherein said alarm module further includes a magnetic base.

20. A highway work zone intrusion alarm system comprising:

a perimeter sensing system including a plurality of sensing lines, a plurality of junction boxes, and a pair of terminal boxes, said sensing lines connected in series to form said perimeter sensing system, each sensing line connected to an adjacent sensing line by one of said junction boxes, said perimeter sensing system terminating at opposite ends at one of said terminal boxes connected to one of said sensing lines, each of said sensing lines including, a resilient pneumatic tube, a electrical switch connection line, and a sleeve containing said tube and said Connection line;

each of said junction boxes including, a weatherproof housing, a pair of tube connections extending from said housing, each attached to the tube of one of said sensing lines, a pair of pressure switches, each switch connected to one of said tube connections, said switches activated upon compression of said tubes caused by an errant vehicle running over said tubes, a pair of weatherproof electrical connectors passing through said housing, each connected to the switch connection line of one of said sensing lines, and electrical circuitry within said junction box, said circuitry connecting said pair of electrical connectors and connecting said electrical connectors to said pressure switches, each of said terminal boxes including, a weatherproof housing, a tube connection extending from said housing, said tube connection attached to the tube of one of said sensing lines, a pressure switch connected to said tube connection, a pair of weatherproof electrical connectors passing through said housing, one of said electrical connectors connected to the switch connection line of one of said sensing lines, and electrical circuitry within said terminal box, said circuitry connecting said pair of electrical connectors and connecting said electrical connectors to said pressure switch;

a connecting cable connected to one of said electrical connectors of said pair of terminal boxes; and an alarm module including, a siren, a strobe, power supply line, and a magnetic base supporting said siren, said base including a switched electrical circuit connecting said power supply line to said siren and said strobe through said connecting cable, said electrical circuit for activating said siren and said strobe upon activation of one of said pressure switches.

* * * * *